US006463687B1

(12) United States Patent
Dorstewitz

(10) Patent No.: US 6,463,687 B1
(45) **Date of Patent: *Oct. 15, 2002**

(54) COLLAPSIBLE SAFETY SIGN

(76) Inventor: Edward J. Dorstewitz, 611 Lake St., St. Joseph, MI (US) 49085

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/160,969

(22) Filed: Sep. 25, 1998

(51) Int. Cl.[7] ..... G09F 15/00
(52) U.S. Cl. ..... 40/610; 40/612; 248/171
(58) Field of Search ..... 40/606, 610, 612; 248/170, 171, 156, 533; 116/63 P; 135/118

(56) References Cited

U.S. PATENT DOCUMENTS

| | | | | | |
|---|---|---|---|---|---|
| 1,406,916 | A | * | 2/1922 | Arnold | 40/606 |
| 2,681,030 | A | | 6/1954 | Hoge | |
| 2,832,555 | A | * | 4/1958 | Terhune | 248/170 |
| 3,051,320 | A | * | 8/1962 | De Loss Barnett | 248/171 X |
| 3,200,786 | A | | 8/1965 | Swezy et al. | |
| 3,220,766 | A | * | 11/1965 | Kates | 135/118 |
| 3,309,049 | A | * | 3/1967 | Albee, Jr. | 248/171 |
| 3,526,200 | A | * | 9/1970 | Doyle | 40/606 X |
| 3,620,496 | A | * | 11/1971 | Bolt et al. | 248/171 |
| 3,701,210 | A | * | 10/1972 | Smith | 40/591 |
| 3,777,428 | A | * | 12/1973 | Caufield | 40/610 X |
| 3,899,843 | A | * | 8/1975 | Doyle et al. | 40/612 X |
| 4,019,271 | A | | 4/1977 | Latimer | |
| 4,309,836 | A | | 1/1982 | Knapp | 40/602 |
| 4,490,934 | A | * | 1/1985 | Knapp | 40/610 X |
| 4,507,887 | A | * | 4/1985 | Seely | 40/606 |
| 4,592,158 | A | | 6/1986 | Seely | 40/603 |
| 4,888,894 | A | | 12/1989 | Brown, Jr. | 40/606 |
| 4,905,391 | A | | 3/1990 | Dillon | 40/610 |
| 4,980,984 | A | | 1/1991 | Kulp et al. | 40/610 |
| 5,152,091 | A | | 10/1992 | Leach | 40/603 |
| 5,318,258 | A | | 6/1994 | Lang | 248/166 |
| 5,472,162 | A | * | 12/1995 | Mason | 40/606 X |
| 5,561,931 | A | * | 10/1996 | Duenkel | 40/603 X |
| 5,725,186 | A | * | 3/1998 | Hillstrom et al. | 40/606 X |
| 5,829,178 | A | * | 11/1998 | Hillstrom | 248/170 X |
| 5,975,499 | A | * | 11/1999 | Ostrobrod | 248/171 X |

FOREIGN PATENT DOCUMENTS

| | | |
|---|---|---|
| AT | 233441 | 5/1964 |

* cited by examiner

*Primary Examiner*—Brian K. Green
(74) *Attorney, Agent, or Firm*—Flynn, Thiel, Boutell & Tanis, P.C.

(57) ABSTRACT

A safety sign is provided which includes a collapsible tripod base that removably supports a hollow tube therein. The hollow tube stores a foldable fabric sign therein which includes pockets at the upper, left and right corners thereof and defines a mast for the sign. The sign is supported on the base by a vertical support rod and includes a horizontal cross member. The horizontal cross member is twistable independently of the base and mast wherein this free-floating arrangement facilitates assembly of the sign while also permitting the sign to twist during windy conditions and allow the wind to spill around the sign in order to prevent the sign from toppling over.

19 Claims, 7 Drawing Sheets

COLLAPSIBLE SAFETY SIGN

FIELD OF THE INVENTION

The invention relates to a safety sign and more particularly, to a collapsible safety sign which readily disassembles for storage and transport.

BACKGROUND OF THE RELATED ART

Typical safety signs include a highly visible sign supported on a base to warn bypassers such as motorists and pedestrians of an emergency, hazard or some other condition which they should be aware of. Such signs are used frequently by a wide variety of users such as construction workers, employees of telephone, power, gas or other utility companies, emergency personnel, survey crews or any other users who need to warn motorists and pedestrians of their presence and potential hazards.

A variety of safety signs have been designed although many of these safety signs are heavy and difficult to set up or transport, particularly if such signs require tools and the like to set up and take down the sign. If the safety sign is being used for an extended period in a stationary location, problems created by these disadvantages may be overlooked. However, many of the aforementioned users do not use the safety sign for long periods in a single location but instead, move from location to location during a single day such that the safety sign is used only temporarily and is assembled, disassembled and transported relatively frequently. In such instances, heavy, bulky signs are inconvenient to set up and transport and thus, frequent users may simply not use the sign due to its inconvenience which ultimately increases risk, not only for the user but motorists and pedestrians as well.

In this regard, additional safety signs have been provided which are more convenient to transport and use. For example, collapsible signs have been provided wherein the sign itself is formed of a fabric material. The fabric is lightweight and permits usage of a framework which may be broken down and transported more easily. However, a number of such signs use a framework which is relatively complex in its structure and assembly such that these signs may still be inconvenient to use and thus, may not be used due to such inconvenience.

Examples of collapsible safety signs are disclosed in U.S. Pat. Nos. 3,200,786, 4,019,271, 4,309,836, 4,592,158, 4,980,984, 5,152,091 and 5,318,258.

The inventive safety sign disclosed herein is an improved safety sign which overcomes a number of the disadvantages associated with known safety signs. The safety sign of the invention includes a collapsible tripod base which removably stores a hollow tube therein. The hollow tube serves the dual function of storing a fabric sign therein while serving as a mast to support the sign during use.

The sign is formed from a foldable fabric material which preferably is formed as a rectangle and includes pockets at the upper, left and right corners to receive support rods therein. The fabric sign is supported on the base by a vertical support rod which projects upwardly from the central tube. The upper end of the support rod is received in the upper pocket of the sign to vertically support the safety sign.

To support the sign laterally, two horizontal support rods or cross rods are joined together to define a cross member or cross bar wherein the opposite ends of the joined cross rods are received in the left and right pockets of the sign to provide shape to the sign. The horizontal cross member is not connected to the base structure and is permitted to move or twist independently relative to the base and the central tube. This free-floating arrangement facilitates assembly of the sign while also permitting the sign to twist during windy conditions and allow the wind to spill around the sign in order to prevent the sign from toppling over. Shock cords are provided to limit the extent of twisting while the sign itself serves to urge the sign to its normal front-facing neutral position or in other words, to return the sign to its neutral position after twisting.

The lowermost corner of the sign is fixed to the base by any suitable connection means, preferably velcro straps which connect to the base. The sign is readily assembled by merely securing the vertical support rod on the central tube, joining the cross rods together and securing the velcro strap to the base. When disassembled, the rods may be bundled next to each other in parallel which permits the sign to be rolled up about the support rods. Since the central tube is hollow and includes a removable cap, the entire fabric sign and support rods can be inserted into the hollow tube for storage and transport.

This sign construction allows for ready assembly and disassembly while also permitting it to be collapsed into a compact readily transportable arrangement. By reducing the complexities associated with assembly, disassembly and transport, a lighter weight sign is provided which is more convenient for use which thereby increases the likelihood that users will use the sign even if frequent stops or movements are required.

Other objects and purposes of the invention, and variations thereof, will be apparent upon reading the following specification and inspecting the accompanying drawings.

Figure 1:
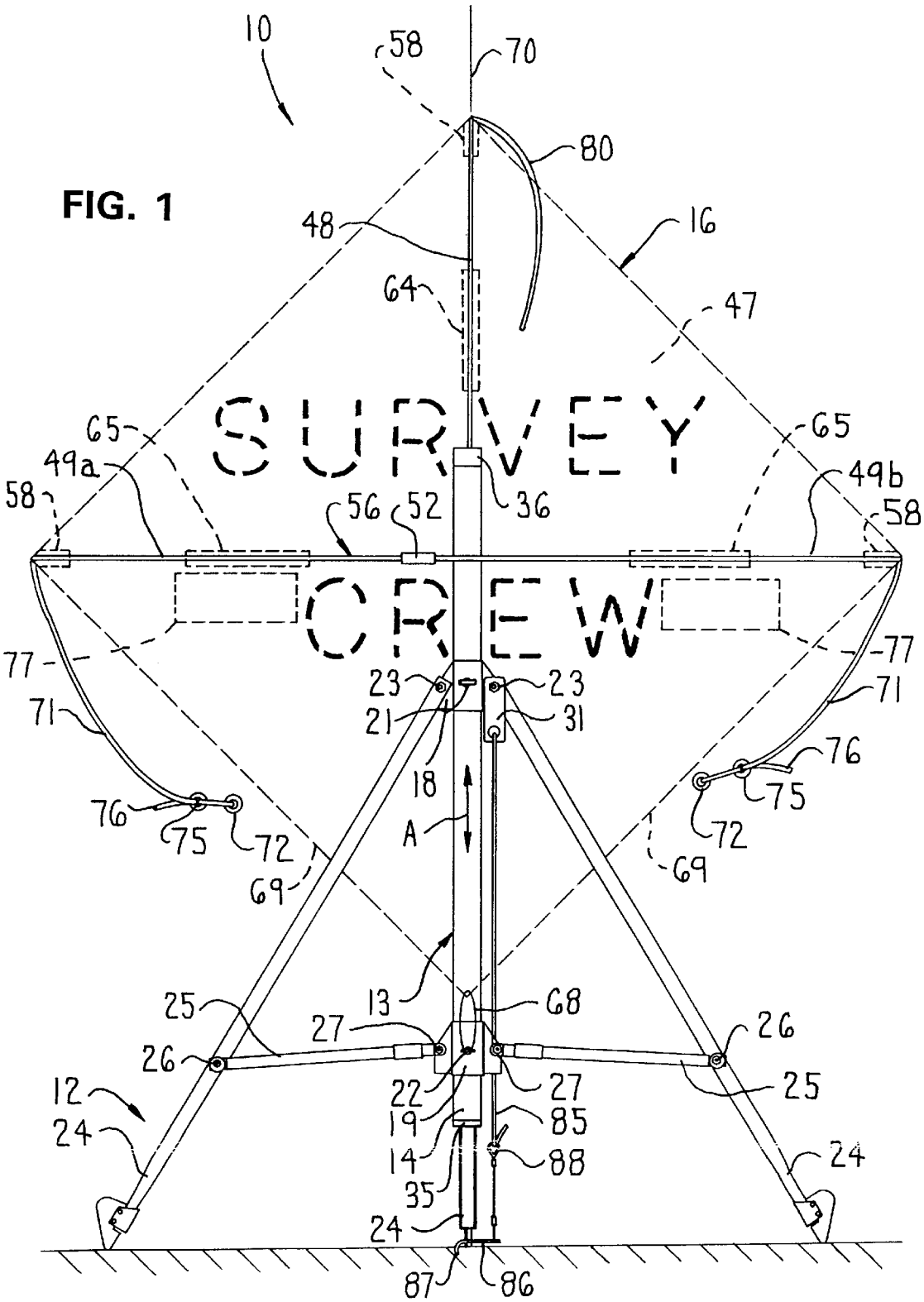
FIG. 1 is a front elevational view of a safety sign of the invention illustrating a base, a mast supported on the base and a sign assembly which is illustrated in phantom outline.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, a safety sign 10 of the invention includes a tripod base assembly 12, a mast 13 which comprises a hollow central tube 14 supported on the base 12, and a sign assembly 16 which is supported by both the central tube 14 and the base 12.

Generally in use, the central tube 14 is removably connected to the base 12 and is hollow to permit the storage of the sign assembly 16 therein. When the sign assembly 16 is removed from the central tube 14, the sign assembly 16 can be readily assembled and supported on the central tube 14.

More particularly, the base 12 includes an annular upper collar 18 and an annular lower collar 19 which is disposed coaxial with but vertically spaced from the upper collar 18. The upper and lower collars 18 and 19 open vertically to slidably receive the central tube 14 axially therethrough as generally illustrated in FIG. 1, and include lock screws 21 and 22 respectively which extend radially therethrough. The lock screws 21 and 22 thread into and through the respective upper and lower collars 18 and 19 and press radially against the exterior surface of the central tube 14 to prevent vertical movement of the central tube 14 relative to the upper and lower collars 18 and 19.

The base 12 further includes a plurality of support legs 24, the upper ends of which are pivotally connected to radial flanges on the upper collar 18 by connectors 23. In the use position as seen in FIG. 1, the legs 24 are circumferentially spaced apart from each other and project radially outwardly and downwardly relative to the upper collar 18. Preferably, three of the legs 24 are provided in a typical tripod arrangement wherein the lower end of legs 24 define a triangular footprint for the sign on the ground, the perimeter of the footprint being defined by straight lines extending between adjacent pairs of the lower leg ends.

The base 12 also includes a brace 25 for each leg. The braces 25 in the use position extend radially between the leg 24 corresponding thereto and a corresponding radial flange on the lower collar 19. More particularly, the outer end of each brace 25 is pivotally connected to the leg 24 by a connector 26, while an opposite inner end is pivotally connected to the radial flange on the lower collar 19 by a connector 27.

When either or both of the lock screws 21 or 22 are unscrewed, the upper and lower collars 18 and 19 are movable vertically relative to each other as generally indicated by reference arrow A. This thereby permits the legs 24 to be folded radially inwardly to a generally vertical storage position. In other words, the base 12 may be folded for storage and transport or unfolded for use. The above described base 12 is conventional and is currently available from Tru Point Products Incorporated of Coloma, Michigan. The base 12 has been previously used to support range poles which are used by surveyors.

Figure 2:
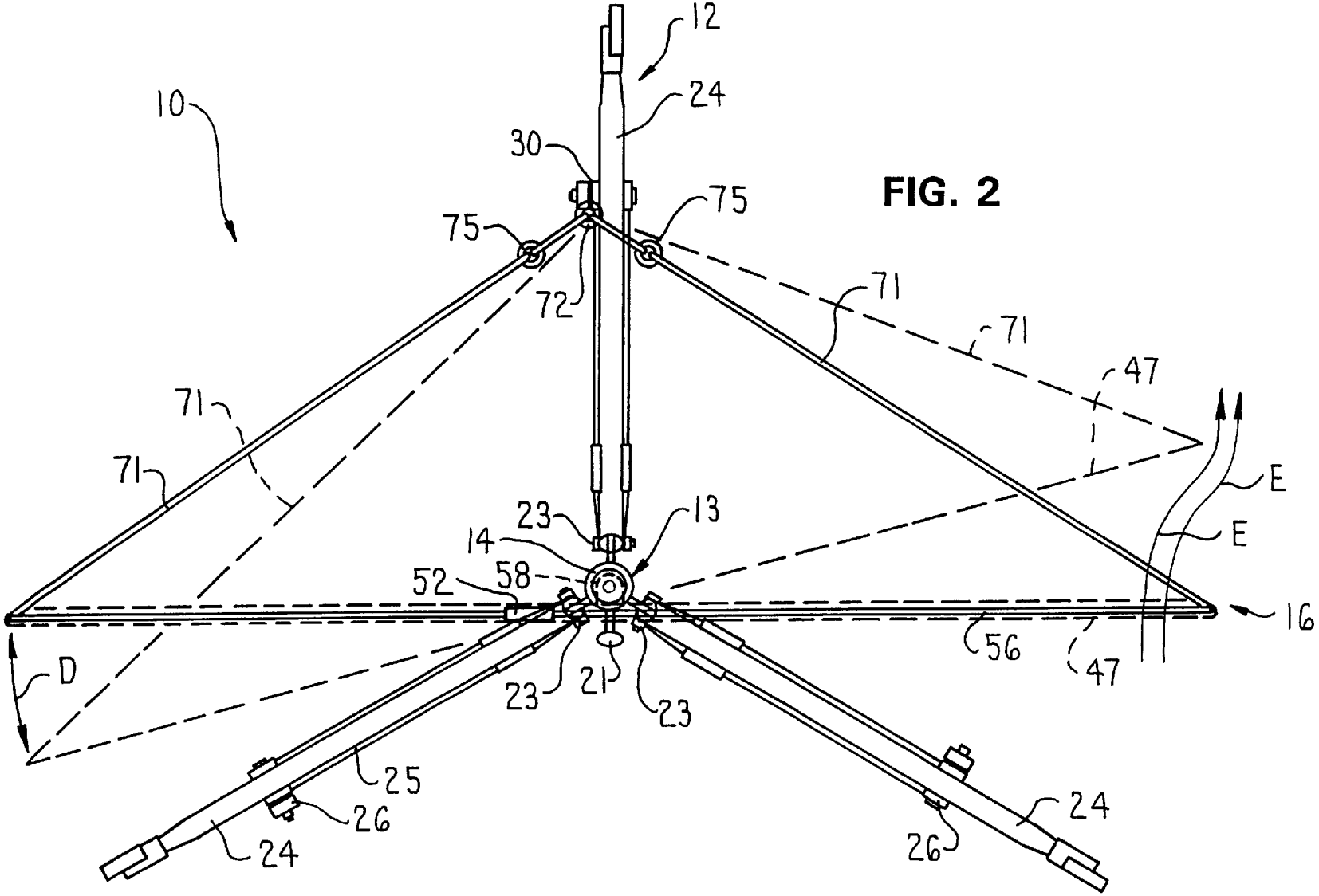
FIG. 2 is a plan view of the safety sign.

The base 12, however, has also been modified as described hereinafter. In particular, one of the legs 24, and preferably the rearward leg 24 as seen in FIG. 2 includes a shock cord mounting ring or connector 30 as will be described in further detail herein. This shock cord connector 30 preferably is connected to a threaded fastener of the connector 26 on the rearward leg 24.

The base 12 also includes an anchor plate 31 which is supported or fastened to a leg 24 by a fastener on one of the connectors 23. The anchor plate 31 will be described in further detail herein.

To support the sign assembly 16, the mast 13 is supported on the base 12. Preferably, the mast 13 comprises the central tube 14 which also is hollow to store the sign assembly 16 therein.

Figure 6:
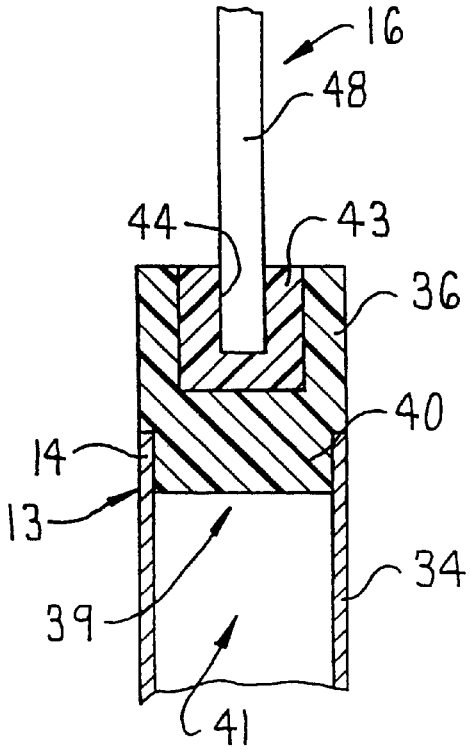
FIG. 6 is a front cross-sectional view of the connection of a support rod to a central storage tube.

More particularly, the central tube 14 is supported coaxially with and through the upper and lower collars 18 and 19. Referring to FIG. 6, the central tube 14 is vertically elongate and has a length which is at least greater than the distance between the upper and lower collars 18 and 19 when the base 12 is unfolded.

Referring to FIGS. 1 and 6, the central tube 14 is hollow and preferably has a cylindrical shape. The tube 14 is defined by an annular outer wall 34 (FIG. 6) which is enclosed at the bottom thereof by a base cap 35 and at the top end thereof by a top cap 36. The central tube 14 preferably is formed of a suitable plastic although any other suitable material may be used.

The top cap 36 may be connected to the tube wall 34 by any suitable connection method although the top cap 36 is removably connected thereto to permit sign storage. The top cap 36 preferably is formed of a plastic material and the lower end thereof has a reduced diameter which thereby defines a plug or insert section 40 which is insertable into the open upper end 39 of the central tube 14. The plug section 40 is dimensioned so as to frictionally fit into the tube wall 34. The friction fit prevents inadvertent removal of the top cap 36 but if sufficient force is applied to the top cap 36, the top cap is removable to permit access to the hollow interior 41 of the central tube 14 through the open upper end 39 thereof.

The upper end of the top cap 36, however, has a greater diameter than the plug section 40 such that an annular lip is formed which limits insertion of the top cap 36 into the open upper end of the central tube 14.

To permit the connection of the sign assembly 16 to the top cap 36, the upper end of the top cap 36 is bored out and receives a support plug 43 which is secured therein. The support plug 43 further includes a rod-receiving bore or socket 44 which opens upwardly and preferably is located coaxial with the outer tube wall 34.

When the central tube 14 is supported in the base 12, the central tube 14 thereby serves as the mast 13 and is height-adjustable to permit adjustment of the height of the sign assembly 16 when the lock screws 21 and 22 are loosened.

With respect to the sign assembly 16, the sign assembly 16 is formed of a sheet-like flexible sign material 47 and a plurality of support rods which serve as a frame for the sign material and in particular, support and provide shape to the sign material 47 during use. For diagrammatic purposes, the sign material 47 is illustrated in phantom outline in FIG. 1 to more clearly illustrate the additional components of the sign assembly 16.

More particularly, the sign material 47 is supported vertically by a vertical support rod 48 which itself is supported in the central tube 14 as will be described herein, and the sign material 47 is supported laterally by horizontal support rods or cross rods 49*a* and 49*b*.

The vertical support rod 48 is a vertically elongate rod. The lower end of the support rod 48 is dimensioned so that it is slidably received into the bore 44 (FIG. 6) of the top cap 36. When the support rod 48 is inserted into the bore 44, the support rod 48 extends vertically from the top of the central tube 14 to a desired height. The support rod 48 thereby defines an extension of the mast 13. The connection of the rod 48 and the top cap 36 is sufficiently strong to provide both vertical and sideward support to the sign assembly 16 during use.

Figure 3:
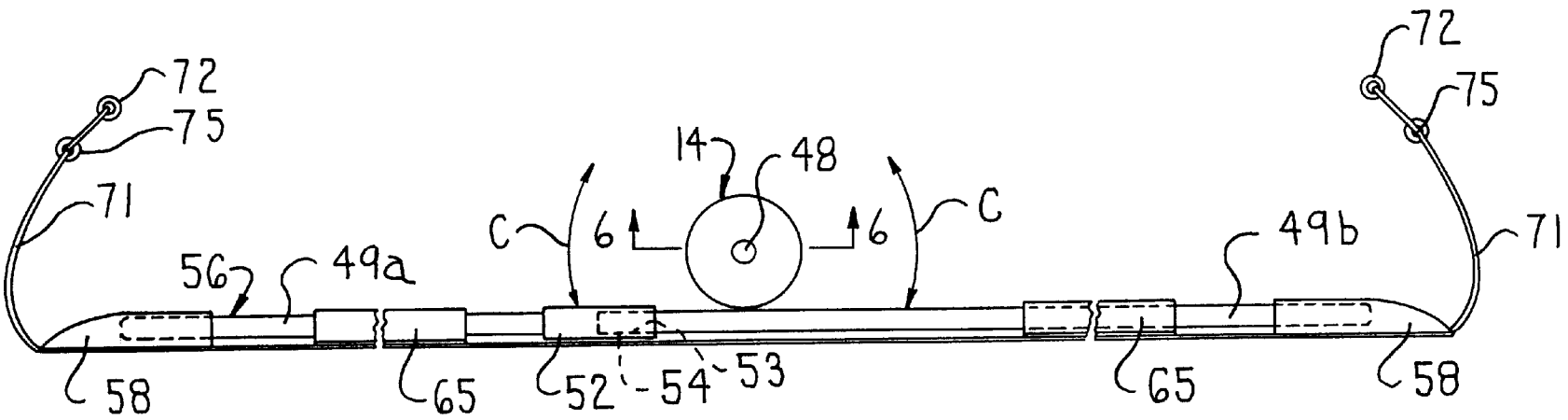
FIG. 3 is an enlarged partial plan view of the cross rods and sign material supported by the cross rods.

To further support the sign material 47, the cross rods 49*a* and 49*b* removably connect together and are secured to the sign material 47, preferably between the left and right corners of the sign material 47 as seen in FIG. 1. Referring to FIG. 3, one of and preferably the leftward cross rod 49*a* includes a cylindrical metal connector tube 52 at an inner end thereof which is fixed to the inner end 54 of the other cross rod 49*a*. An open end of the connector tube 52 projects beyond the inner end of the cross rod 49*a* and opens sidewardly to define a bore or socket 53 which is adapted to slidably receive the end 54 of the rightward cross rod 49*b* therein.

As described herein, while the cross rods 49*a* and 49*b* are supported on the sign material 47, the arrangement is flexible enough such that the cross rods 49 and 49*a* may be moved laterally away from each other in the direction of reference arrows B (FIG. 4) to permit the insertion of the rod end 54 into the socket 53 of the connector tube 52 until the rod end 54 is fully seated therein. At such time, the cross rods 49*a* and 49*b* are rigidly connected together to define a horizontally extending cross member 56 which extends horizontally between the opposite side edges of the sign material 47.

As discussed hereinafter, all of the support rods 48, 49*a* and 49*b* are attached to the sign material 47 and effectively define a frame therefor. The sign material 47 preferably is a rip-stop nylon although it may be any suitable flexible fabric or other sheet-like material such as canvass. Preferably, the sign material 47 has a highly visible color such as orange.

Figure 5:
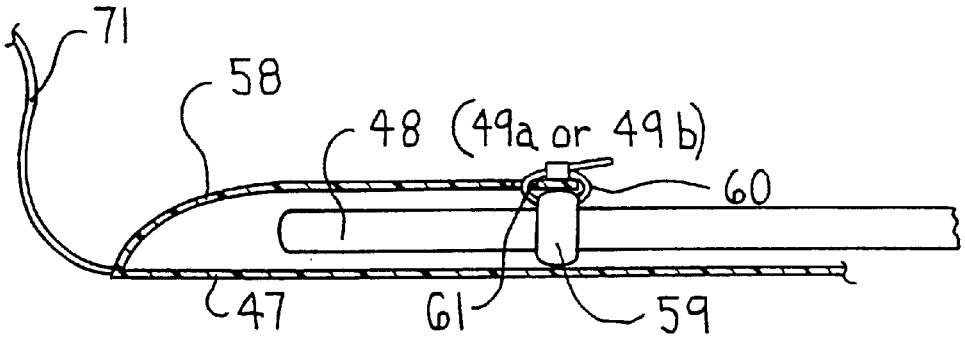
FIG. 5 is an enlarged cross-sectional plan view of a pocket at the corner of the sign material and an end of a support rod received therein.

The sign material 47 preferably has a rectangular or diamond-like shape although other suitable shapes may be provided if desired. To support the support rods 48, 49*a* and 49*b*, pockets 58 are provided at the upper, left and right sides and specifically, the corners of the sign material 47. Preferably, the pockets 58 are formed of a suitable rip-resistant material such as nylon and are open on one side generally towards the center of the sign material 47. Each pocket 58 receives the end of a respective one of the support rods 48, 49*a* and 49*b*. A representative one of the pockets 58 is illustrated in FIG. 5 wherein the end of the support rod 48 or alternatively the support rods 49*a* and 49*b* is received into the pocket 58.

To secure the end of the respective support rod within this pocket 58, a rubber retaining ring 59 is provided within the interior of the pocket 58 and is secured to the pocket 58 by a suitable retaining strap 60 which extends through the opening in the ring 59 and through a corresponding hole 61 formed near the edge of the pocket 58. The strap 60 thereby secures the ring 59 to the pocket 58, and since the ring 59 is frictionally fitted over the rod 48 (49*a* or 49*b*), the end of the rod is in effect secured to the sign material 47 and does not fall out of the pockets 58 during assembly and disassembly. The ring 59, however, permits removal of the rod 48, 49*a* or 49*b* if so desired such as for repair.

To further secure the support rods onto the sign material, the sign material 47 also includes a vertical sleeve 64 aligned with the upper pocket 58 through which the support rod 48 extends, and a pair of horizontally spaced apart horizontal sleeves 65 through which the support rods 49*a* and 49*b* extend. These sleeves 64 and 65 preferably are sewn in place and formed of the same rip-resistant material as the sign material 47. These sleeves 64 and 65 are open ended to permit the support rods 48, 49*a* and 49*b* respectively to be slid therethrough.

The sleeves 64 and 65 thereby assist in securing the support rods to the sign material 47. Further, these sleeves 64 and 65 prevent billowing of the sheet material 47 away from the support rods in a backwind, i.e. a wind blowing forwardly. In a backwind, however, the sign may still swivel to allow the wind to spill around the sides.

To mount the sign assembly 16 to the base 12, the lower end of the vertical support rod 48 is inserted into the top cap 36 such that the support rod 48 extends upwardly therefrom and supports the sign material 47 vertically. In addition, the horizontal cross rods 49*a* and 49*b* are connected together at their inner ends by the connector tube 52 such that the left and right corners of the sign material 47 are supported in the expanded condition illustrated in FIGS. 1 and 4. The sign material 47 thereby is suspended from the base 12 and in particular, from the central tube 14 which extends upwardly from the base 12.

The lowermost corner of the sign material 47 also includes connector straps 68 which are preferably formed from velcro and extend downwardly and wrap around the lowermost lock screw 22. The connector straps 68 pull the sign material 47 downwardly and secure the lower corner thereof in place. The sign material 47 thereby is secured to the base 12 and central tube 14 solely by the upper support rod 48 and the connector straps 68.

The cross rods 49, however, are not positively connected or attached to the central tube 14 but instead lie closely against this tube. The cross member 56 effectively is free-floating and is able to pivot sidewardly as indicated by reference arrows C in FIG. 3. Thus, during windy conditions, the left or right corners of the sign assembly 16 can swing relative to the central tube 14 (reference arrow D in FIG. 2) which reduces the wind acting on the sign material 47 and in fact, allows wind to spill outwardly and past the sign material 47 as indicated diagrammatically in FIG. 2 by reference arrows E.

More particularly, since only the upper and lower corners of the sign material 47 are positively secured to the base 12 and central tube 14, a generally vertical pivot axis 70 (FIG. 1) is effectively defined therebetween about which the sign material 47 is able to swivel. Since the cross member 56 is rigid and provides rigidity to the sign material 47 across the central section thereof between the left and right corners, the left and right corners therefore move forwardly or rearwardly in response to wind as described herein.

Referring to FIG. 1, the lowermost corner of the sign material 47 preferably extends below the upper collar 18 of the base 12 such that the left and right lower edges 69 of the sign material 47 lie against the support legs 24. Since the sign material 47 lies against the legs 24, particularly as the sign material 47 swings in response to wind, these edges 69 therefore resist swinging and tend to urge the sign material 47 back to a front facing neutral position once the wind dissipates or lowers. In effect, the sign material 47, by way of its contact with the legs 24 is self-centering although this self-centering is not required, since a sign assembly 16 may be provided which is small or high enough such that there is little if any contact between the sign edge 69 and the legs 24.

Figure 7:
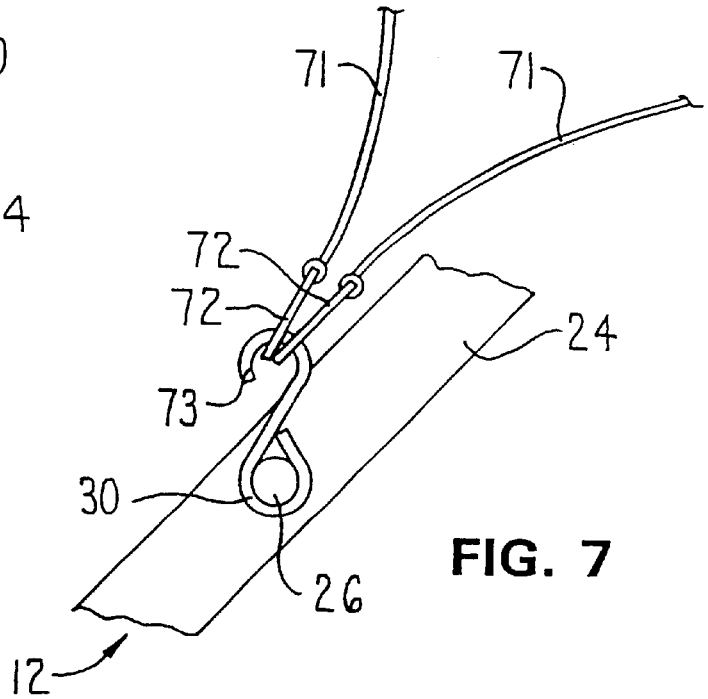
FIG. 7 is an enlarged partial view of the connection of shock cords to the base.

Despite this self-centering function provided by the sign material 47, shock cords 71 are provided at the left and right corners of the sign material 47 to define limits for the swivelling of the sign. The shock cords 71 have washer-like eyelets 72 at the end thereof. As seen in FIGS. 2 and 7, these eyelets 72 hook onto the open end of the shock cord connector 30 which is mounted on the leg 24. The shock cord connector 30 preferably has an S-shape which defines a hook 73 on one end.

To adjust the length of the shock cord 71, each shock cord 71 also includes a cinch ring arrangement 75. Pulling on the strap end 76 of the shock cord 71 thereby pulls the shock cord 71 tighter and fixes or locks the length of the shock cord 71 although the cinch ring arrangement 75 may be released during disassembly. If the wind is excessive, the shock cords 71 limit the extent that the sign material 47 is able to swing or twist.

Figure 4:
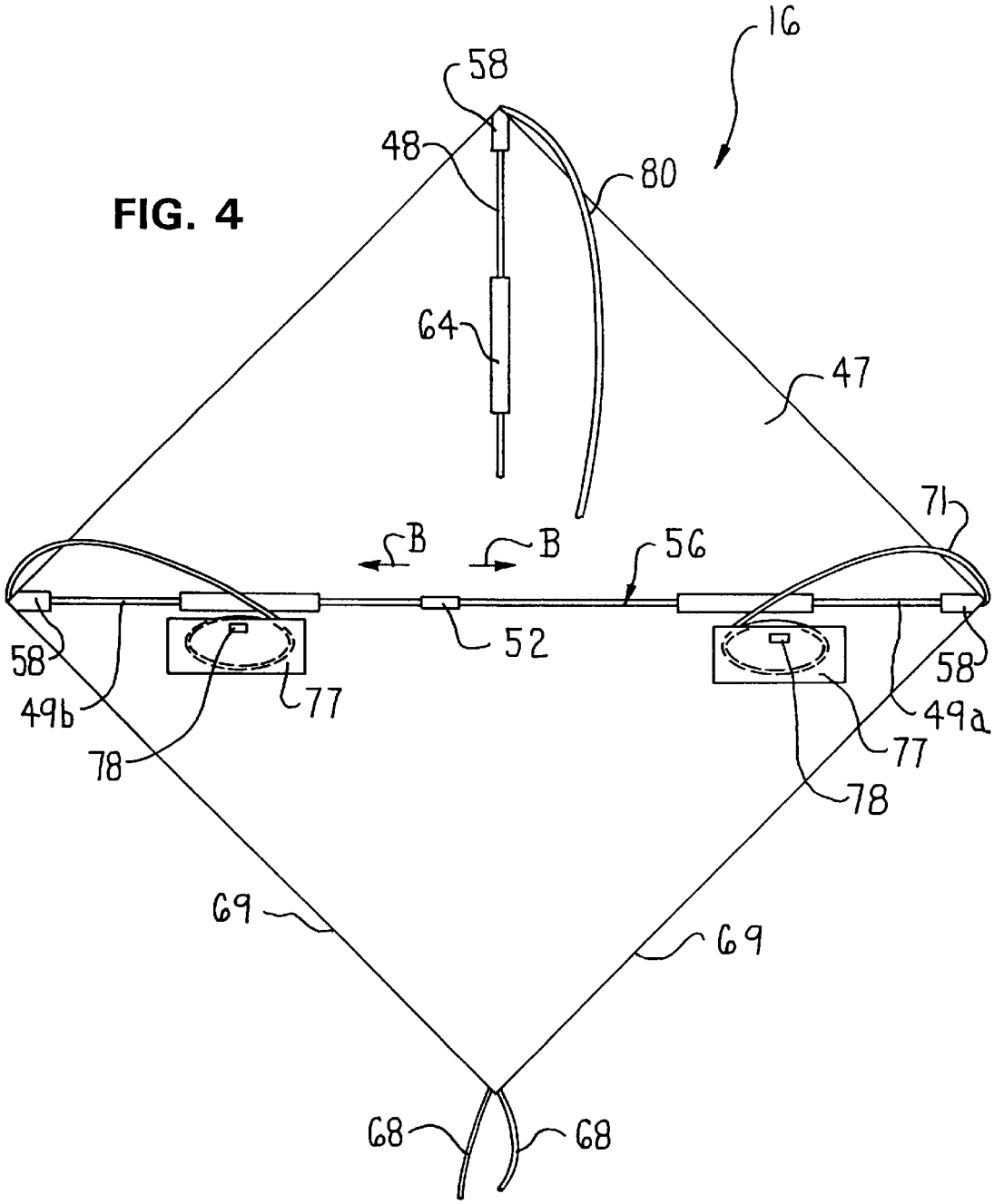
FIG. 4 is a back elevational view of the sign assembly.

The sign material 47 also includes upward-opening pockets 77 on the back side thereof in which the shock cords 71 may be stored as seen in FIG. 4. Each pocket 77 is held shut by a suitable fastener 78 such as velcro at the top thereof.

When the sign 10 needs to be stored, the sign 10 can be readily disassembled. In particular, the disassembly and storage process involves disengaging the velcro connector straps 68, and disconnecting the cross rods 49*a* and 49*b* one from the other. The shock cords 71 also are unhooked or disengaged from the shock cord connector 30, and the vertical support rod 48 is removed from the top cap 36 such that the sign material 47 is completely removed from the base 12 and central tube 14. All of these components, however, are joined together as part of the sign assembly 16, thus, eliminating separate components which may be lost.

Thereafter, the top cap 36 generally is removed and the sign assembly 16 is stored in the hollow interior 41 thereof. More particularly, the sign assembly 16 is first folded and then rolled up to fit in the hollow interior 41.

Figure 8:
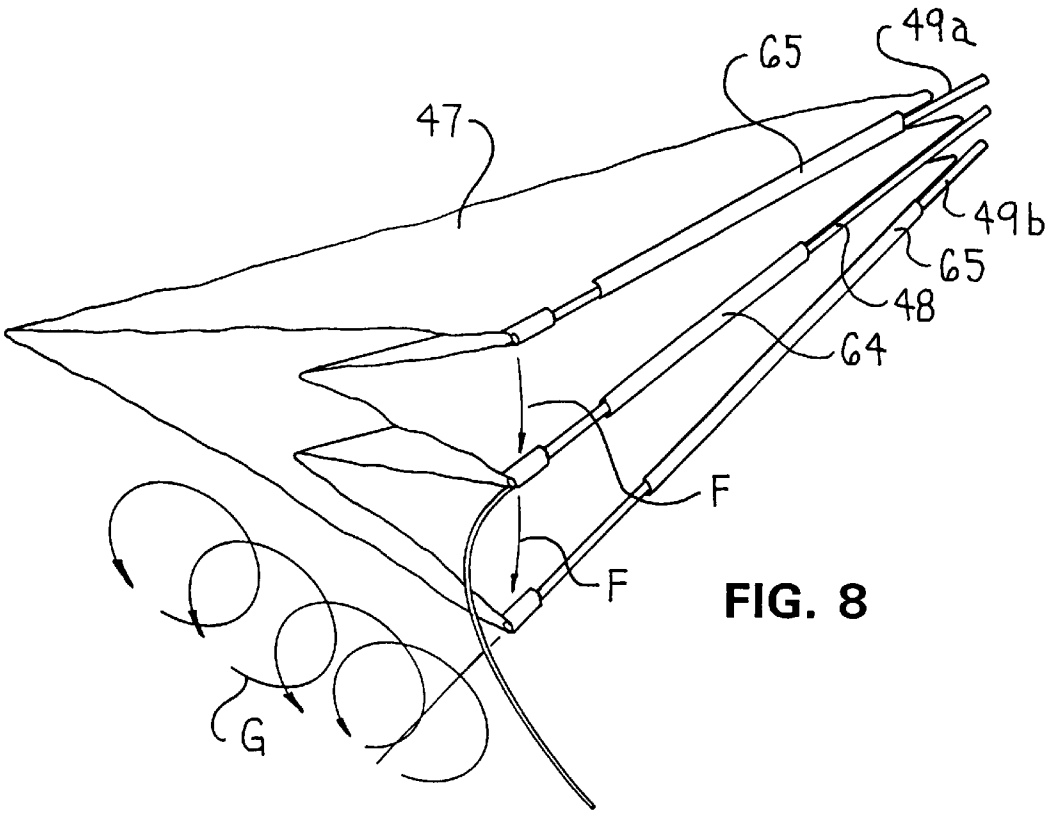
FIG. 8 is a perspective view diagrammatically illustrating the sign assembly being rolled up for storage.

As seen in FIG. 8, the support rods 48, 49*a* and 49*b* are first folded up next to each other, generally in parallel as indicated by reference arrows F. Thereafter, the bundle of rods 48, 49*a* and 49*b* are rolled up into the sheet material 47 as indicated by reference arrows G to form an elongate roll.

Figure 9:
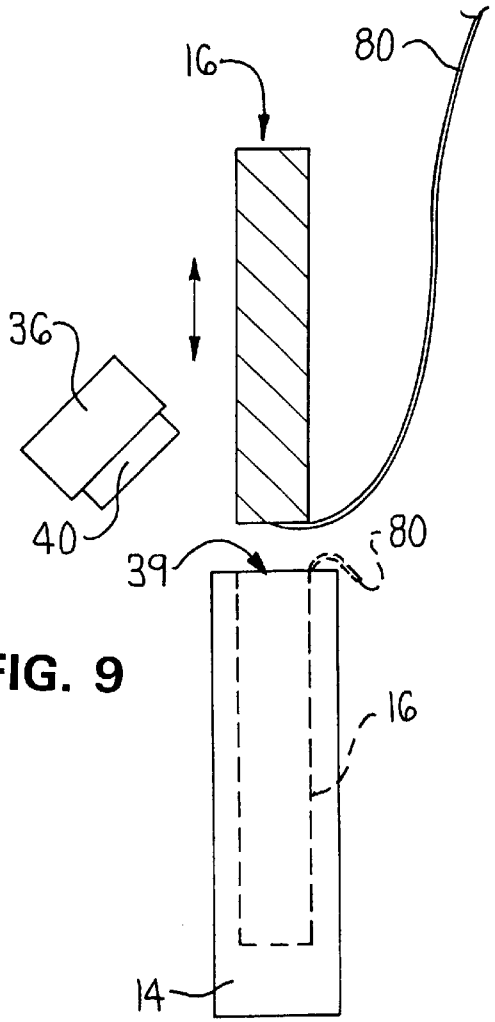
FIG. 9 is a front elevational view diagrammatically illustrating the rolled up sign assembly being stored in the central tube.

To assist in removing the sign assembly 16 from the tube interior 41, the upper corner of the sign material 47 includes a relatively long pull strap 80 (FIGS. 4 and 8). When inserting the rolled up sign assembly 16 into the tube 14, the pull strap 80 is oriented at the bottom or end of the sign assembly 16 which is inserted first into the hollow interior 41, and when fully inserted, the end of the pull strap. 80 is accessible from the top of the hollow tube 14 as seen in phantom outline in FIG. 9. The top cap 36 may then be inserted into the hollow tube 14, and the base 12 folded up to form a lightweight compact package.

To remove the sign assembly 16, a user need only remove the top cap 36 and pull the pull strap 80 upwardly. The sign assembly 16 can then be unrolled and reassembled onto the base 12 and tube 14 to set up the safety sign 10.

The sign material 47 also includes a message on the front surface thereof which preferably is formed of a fluorescent material. The message may be any suitable message such as "SURVEY CREW" as illustrated in FIG. 1.

Figure 10:
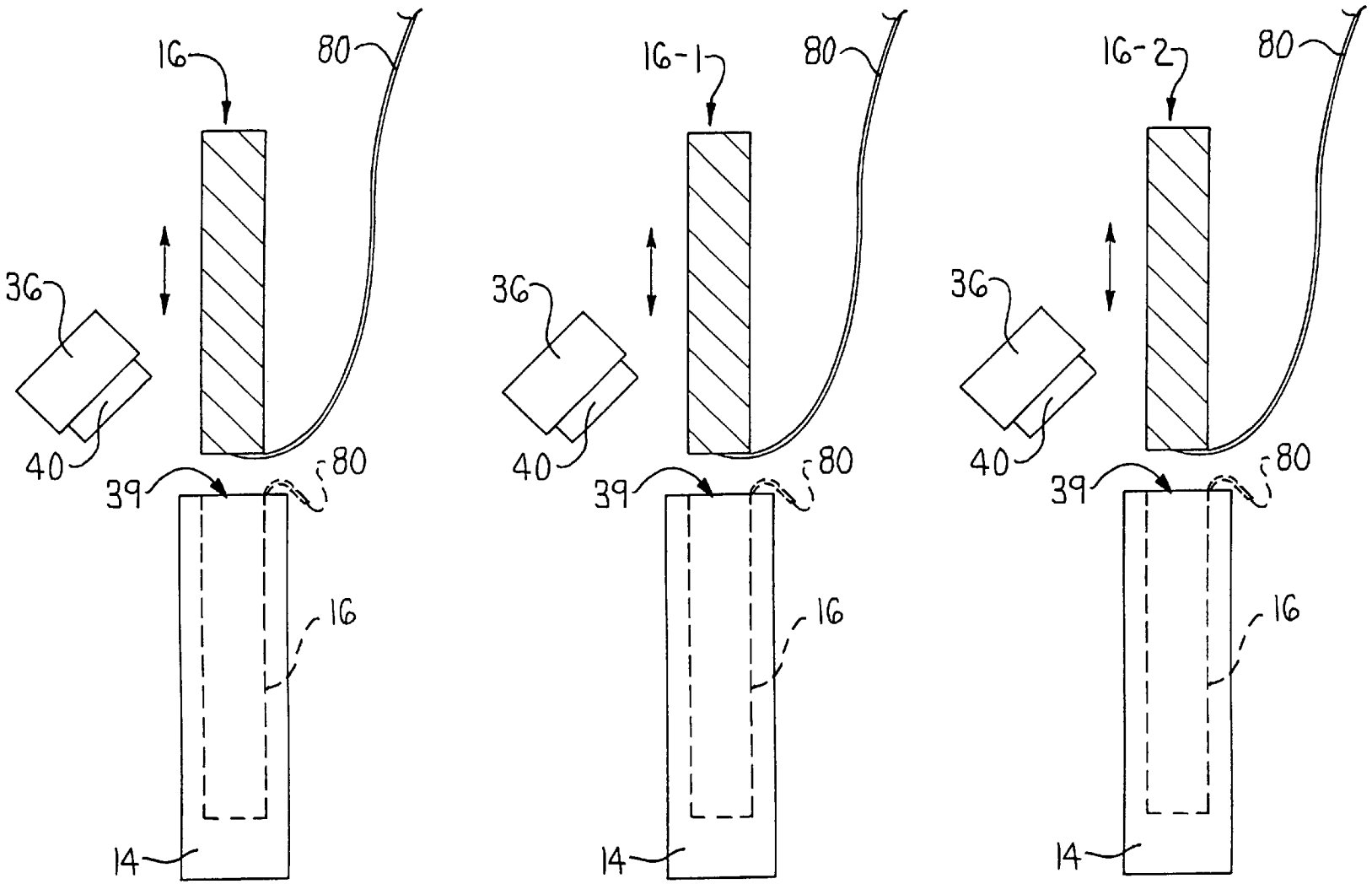
FIG. 10 diagrammatically illustrates a plurality of tubes with different signs associated therewith.

Since the hollow tube 14 can be entirely removed from the base 12, it may be preferred to provide the sign 10 with a plurality of the hollow tubes 14 (FIG. 10) wherein each hollow tube stores a sign assembly 16, 16-1 or 16-2 having a different message thereon. For example, a user may use a number of different messages during a day depending upon the situation. In this instance, a plurality of the hollow tubes 14 may be provided wherein a user may select a tube containing a sign having an appropriate message and insert this tube into the base 14 as the situation dictates. The appropriate tube is merely slipped into the base through the collars 18 and 19 and secured in place by the lock screws 21 and 22 which are tightened by hand. The tube 14 may be readily changed out to a tube with a different message without requiring any tools. Thus, the base 12 may be provided as part of a multi-tube system.

To further secure the sign 10 in place, the anchor plate 31 includes a tether 85 secured thereto which hangs downwardly and has a cam plate 86 at the free end thereof. The anchoring cam plate is disposed within the sign's footprint as defined by the lower ends of the legs 24. The cam plate includes a cam leg 87 which fits into an available crevice such as a crack or expansion joint in concrete, and when the sign is tended to be lifted upwardly, such as in a strong wind, the cam plate 86 is pulled on by the tether 85 such that the cam plate 86 pivots and anchors or grip the crevice even harder. This thereby prevents the sign 10 from tipping. The tether 85 also includes a cinch ring arrangement 88 to pretension the tether 85 and fix the cam plate 86 in place.

As a result of this arrangement, a lightweight safety sign is provided. The sign 10 may be readily assembled and dissembled which promotes use, and is easily transportable. The sign 10 also has a free-floating cross bar arrangement which accommodates wind but does not require separate or complex fasteners. Further, since the sign 10 is self-centering, further centering structure is not required.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A sign comprising:

a base;

a mast which is supported on said base and extends vertically therefrom; and a sign assembly which is supported on said mast, said sign assembly comprising a sheet-like flexible sign material which is vertically enlarged and a frame structure for said sign material, said frame structure comprising a vertical support member which supports said sign material vertically and a horizontal cross member which supports said sign material laterally, said vertical support member being connected to an upper side of said sign material and being supported vertically on said mast such that said sign material is suspended from said mast by said vertical support member, said horizontal cross member having opposite ends connected to left and right sides of said sign material, said horizontal cross member extending on opposite sides of said mast but being free of direct connections to said mast and said vertical support member such that said cross member is suspended from said vertical support member by said sign material and is movable independently of said mast, said sign material including a lower side which includes a connector that is removably connected to at least one of said mast and said base, said vertical support member and said connector defining a generally vertical swivel axis extending therebetween about which said cross member and said sign material can swivel.

2. A sign according to claim 1, wherein said vertical support member and said horizontal cross member are elongate rods, and said left side, said right side and said upper side of said sign material include pockets thereon which receive an end of a respective one of said vertical support member and said cross member.

3. A sign according to claim 2, wherein said sign material is generally diamond-shaped and said pockets are defined at a left corner, a right corner and an upper corner thereof.

4. A sign according to claim 3, wherein said sign material includes a lower corner which supports said connector thereon, said connector connecting said lower corner to said one of said mast and said base.

5. A sign according to claim 1, wherein said mast is adjustable in height relative to said base to permit said sign material to be raised and lowered.

6. A sign according to claim 5, wherein said mast is a hollow tube and said sign assembly is detachable from said mast, said hollow tube having an open end to receive said sign assembly therein.

7. A sign according to claim 6, wherein more than one said hollow tube and more than one said sign assembly is provided wherein each said hollow tube includes one said sign assembly therein, each said sign assembly having a different surface indicator thereon, said base adapted to receive one said hollow tube which is selected based upon said surface indicator of said sign assembly associated therewith.

8. A sign according to claim 6, wherein said base is a foldable tripod.

9. A sign according to claim 1, wherein said sign material is generally diamond-shaped, said vertical support member being connected to an upper corner, said connector being connected to a lower corner, and opposite ends of said cross member being connected to respective left and right corners of said sign material, said base having a plurality of downwardly extending legs wherein said lower corner is disposed between a pair of said legs and said sign material extends upwardly and sidewardly away from said lower corner to said left and right corners while being in contact with said pair of said legs to resist swivelling of said sign assembly.

10. A sign comprising:

a base having a base bracket and a plurality of legs extending downwardly and outwardly away from said base bracket, said legs being pivotally connected to said base bracket so as to be movable between folded and unfolded positions;

a hollow tube which is slidably connected to said base bracket, said base bracket including locking means for fixing said hollow tube relative to said base bracket, said locking means being releasable to permit adjustment of a height of said hollow tube relative to said base; and a sign assembly removably supported on said hollow tube which has a collapsible frame structure and a sign material supported on said frame structure, said frame structure including a vertical support rod which has an upper end connected to said sign material and a lower end connected to said hollow tube such that said sign material is suspended from said vertical support rod to vertically support said sign material on said hollow tube and said base, said frame structure further including a cross member having opposite ends connected to respective left and right sides of said sign material to spread said left and right sides laterally away from each other wherein said cross member is suspended from said vertical support rod by said sign material, said cross member extending transversely adjacent to said hollow tube but being free of direct connections with said hollow tube and said vertical support rod, said sign material further including connector straps at a lower side thereof which connect said lower side to at least one of said hollow tube and said base, said cross member having detachable left and right rod sections and said sign material being a flexible fabric such that said left and right rod sections and said vertical support rod may be laid in parallel and rolled up together with said sign material when said sign assembly is removed from said hollow tube, said hollow tube having an open upper end to receive said sign assembly therein when said sign assembly is rolled up.

11. A sign according to claim 10, wherein said upper side of said sign material includes a pull strap which extends to a top of said hollow tube when said rolled up sign assembly is stored there in, said pull strap being accessible to permit manual pulling thereof and removal of said rolled up sign assembly from said hollow tube.

12. A sign according to claim 10, wherein said sign material includes pockets on said left side, said upper side and said right side which receive respective ends of said left rod section, said vertical support rod and said right rod section therein.

13. A sign according to claim 12, wherein said pockets are fixedly secured to said respective rod ends.

14. A sign according to claim 13, wherein said sign material includes an open-ended sleeve on a back side thereof for each of said left and right rod sections and said vertical support rod which extend through said sleeves and are supported thereby on said sign material.

15. A sign according to claim 14, wherein said left and right sides have an elongate strap which removably connects to said base to limit swivelling movement of said sign, said sign material including storage pockets thereon which receive said straps therein during storage.

16. A sign according to claim 15, wherein said base includes a tether which secures said base to a support surface.

17. A sign according to claim 10, wherein said connector straps on said lower edge are vertically elongate and adjustable so as to extend vertically between said lower side and said one of said hollow tube and said base as the height of said hollow tube is adjusted relative to said base.

18. A sign according to claim 10, wherein said sign material is diamond-shaped and has a left corner, upper corner and right corner to which said left rod section, vertical support rod and right rod section respectively are connected.

19. A sign comprising:

a base having a central base bracket and a plurality of legs extending downwardly and outwardly away from said base bracket;

a vertically enlarged sign supported on said base; and a tether unit which is connected to said base for securing said base to a support surface, said tether unit including a tether strap which hangs downwardly from said base said tether strap having an upper end secured to said base and a lower end extending downwardly therefrom, said tether strap including an anchor device at the lower end thereof which is adapted to fit into and grip an opening in a support surface for removable gripping engagement therewith, said anchor device being a generally L-shaped cam plate whereby gripping of said cam plate with an opening of a support surface increases upon upward tensioning of said tether strap, said tether unit further including a pretensioning device which tensions said tether strap upwardly.

* * * * *